United States Patent [19]

Thomas

[11] Patent Number: 4,934,084

[45] Date of Patent: Jun. 19, 1990

[54] REINFORCED FIREARM STOCK

[76] Inventor: Mitchell Thomas, 808 2nd St. NW., Valley City, N. Dak. 58072

[21] Appl. No.: 403,632

[22] Filed: Sep. 6, 1989

[51] Int. Cl.[5] ..... F41C 23/00
[52] U.S. Cl. ..... 42/71.01
[58] Field of Search ..... 42/71.01

[56] References Cited

U.S. PATENT DOCUMENTS 2,753,642 7/1956 Sullivan ..... 42/71.01
4,512,101 4/1985 Waterman, Jr. ..... 42/71.01

FOREIGN PATENT DOCUMENTS 2017087 10/1971 Fed. Rep. of Germany ..... 42/71.01
2042465 3/1972 Fed. Rep. of Germany ..... 42/71.01

*Primary Examiner*—Charles T. Jordan
*Assistant Examiner*—W. Richard Wendtland
*Attorney, Agent, or Firm*—Krass & Young

[57] ABSTRACT

The invention pertains to a lightweight reinforced firearm stock. The stock being internally reinforced by an epoxy resin and reinforcing fiber composition. Further, the internal reinforcement is displaced in certain areas by macroscopic displacement members, such as expanded styrene pellets or gelatin capsules.

18 Claims, 1 Drawing Sheet

REINFORCED FIREARM STOCK

FIELD OF THE INVENTION

The invention pertains to firearm stocks and more particularly to hollow firearm stocks which are reinforced with a filler material.

BACKGROUND OF THE INVENTION

Sportsmen and militia utilize firearms daily throughout the United States and the world. Many companies mass manufacture rifles, shotguns, and other weapons to meet this demand.

The nature of such shoulder weapons, in general, poses several problems. A fully loaded medium caliber (such as a 0.30–06) rifle equipped with telescopic sight could easily weigh ten (10) pounds. Carrying such a weapon over even moderate distances or for extended time periods can pose a considerable difficulty. The user tires and muscular fatigue contributes to unsteadiness of aim and inaccuracy of shot placement.

Further, mass produced firearms do not provide a solid or full contact fit between the barrelled-action of the firearm and the stock. Mass produced stocks are machined to fit all barreled-actions in a particular series. Since no two barreled-actions are exactly the same, this requires tolerance, or space, to be built into each stock. When the weapon is fired, this tolerance allows the recoiling metal barreled-action to move slightly before coming into full contact with the stock. The moving barreled-action gains momentum before striking the stock and transfers more energy instantaneously to the shooter. This "hammer action" increases the apparent recoil of the firearm and has a destructive effect on the stock. As the barreled-action repeatedly hammers the stock bedding surfaces, the stock can crack and split around the receiver. The lack of solid fit also causes the metal to inconsistently rest on the bedding surface for subsequent shots and a decrease in accuracy potential also results.

Manufacturers historically carved firearm stocks from hard woods, such as maple, walnut, mesquite, mahogany, oak, and ash. More recently, manufacturers have begun to create stocks from laminated wood blanks. Either of these result in solid stocks, which are heavy and difficult to machine to achieve precise bedding.

Attempts to reduce the weight of stocks led to the use of hollowed-out, composite firearm stock shells. The shell remained hollow or was filled with sound deadening foam or fiber filler. The composite shell reduces stock weight, but lacks the structural integrity necessary to provide solid bedding for the barreled-receiver. The hollow, composite shell does not absorb significant amounts of recoil energy which is therefore transmitted to the shooter; furthermore, this type of stock does not improve the rigidity of the firearm; and as a result of the foregoing, accuracy suffers.

The present invention provides a lightweight, high strength firearm stock which overcomes the previously described problems of conventional firearm stocks.

SUMMARY OF THE INVENTION

There is disclosed herein a lightweight, reinforced stock for a firearm. The stock comprises a hollow-shell defining an exterior surface of the stock and further defining an interior cavity. The stock includes a body of rigid reinforcing material disposed in at least a portion of the interior cavity as well as a plurality of lightweight, macroscopic displacement members disposed in the body of rigid reinforcing material. The reinforcing material strengthens the stock while the displacement members create a plurality of macroscopic voids in the reinforcing material and thereby reduce the overall weight of the stock.

The hollow shell of the stock may be fabricated from natural wood or synthetic polymeric materials and may further define additional cavities therein. The stock may include a second hollow shell defining a second exterior portion thereof; said second shell further defining a second interior cavity having a second body of rigid reinforcing material disposed in at least a portion thereof and a second plurality of macroscopic displacement members disposed in the second body of reinforcing material.

The rigid reinforcing material may also include a fibrous material dispersed therein to further aid in strengthening the stock. The fibrous material may comprise chopped glass fibers, polymeric fibers such as aramid fibers, carbon fibers, or the like. The rigid reinforcing material may, in some embodiments, comprise an epoxy resin. The displacement members are configured to create a plurality of macroscopic voids. These voids are at least one millimeter, and preferably 5–25 millimeters, in size. The displacement members may in particular embodiments comprise hollow gelatin capsules or expanded polystyrene pellets.

The present invention may also be adapted to provide a reinforcing structure for use within a hollow article. The reinforcing structure comprises a body of rigid reinforcing material disposed in at least a portion of the hollow article and a plurality of lightweight, macroscopic displacement members disposed in the body of rigid reinforcing material. The reinforcing structure may be used in conjunction with building panels, doors, furniture, vehicles, and other such structures.

BRIEF DESCRIPTION OF THE DRAWINGS

These and other features and aspects of the present invention will become clear from the following detailed description of the invention in which.

DETAILED DESCRIPTION OF THE INVENTION

Figure 1:
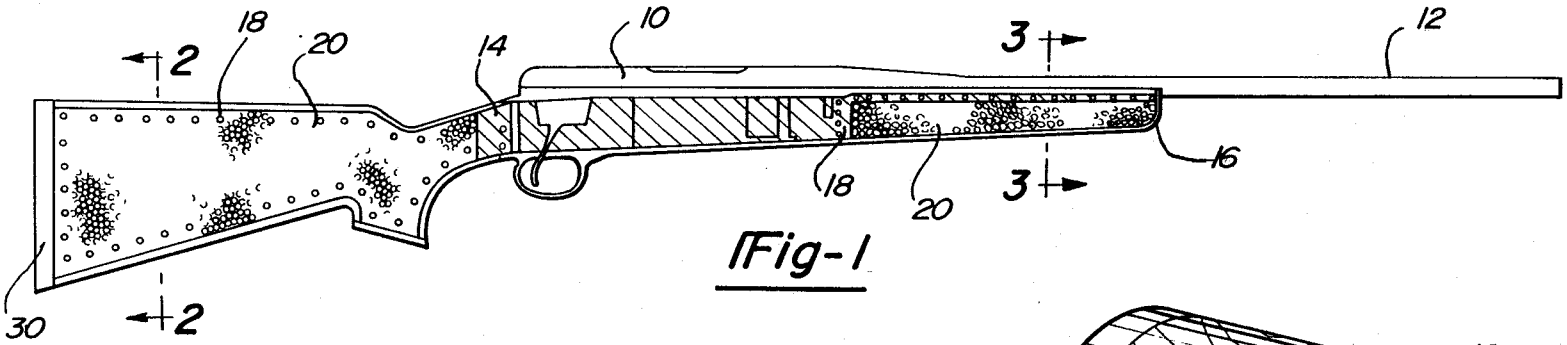
FIG. 1 is a cut-away side view of a firearm including a stock fabricated in accord with the present invention.

The present invention decreases the overall weight of a firearm while improving the bedding, recoil and accuracy qualities of a barreled-action mated to a stock.

As Illustrated with reference to FIG. 1, a firearm action 10 and barrel 12 combination typically requires a solid surface, such as bedding area 14, for proper connection to the remaining portion of the stock. In accord with the principles of the present invention, a stock shell 16 defines the stock exterior while providing an interior cavity 18 which forms the base for eventual bedding of the action 10 and barrel 12. The stock includes a filler material 20, which will be described in greater detail herein below, disposed within the interior cavity 18.

The stock shell 16 is prepared from a standard wood firearm stock blank. Typically, the blank is split open to expose the interior of the blank for hollowing. Locator pins are attached to the split halves to enable accurate reassembly of the halves after hollowing. The split blank is carved by conventional shaping or milling processes to provide a proper exterior stock configuration, as well as the hollow interior cavity 18. A duplicating machine can be used to facilitate this processes as is conventionally known in the industry. The stock is reassembled utilizing the location pins and after reassembly, the filler material is provided therein to replace the internal wood removed in shaping the interior cavity 18. Alternatively, the stock shell 16 may be a fabricated from a synthetic polymeric material or fiber composites (utilizing carbon or glass fibers, for example), by molding, casting or other such shaping processes.

Figure 2:
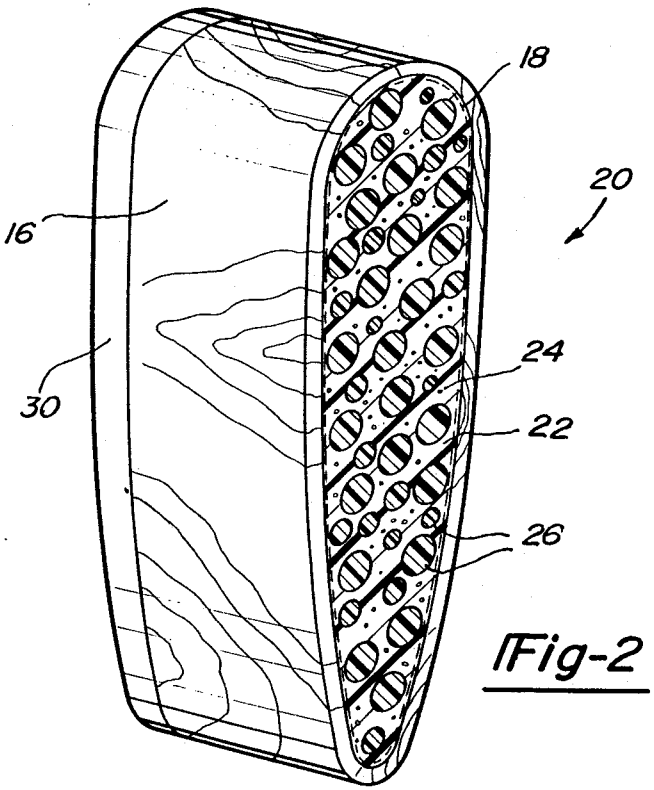
FIG. 2 is a perspective sectional view of the stock of FIG. 1, cut along line 2—2.
Figure 3:
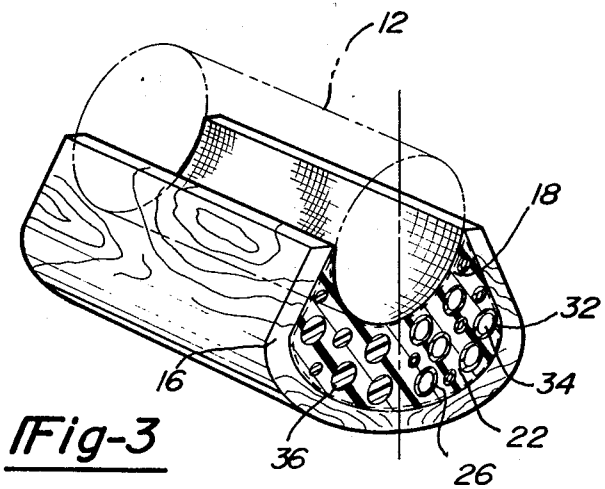
FIG. 3 is a perspective sectional view of the stock of FIG. 1, cut along line 3—3.

FIGS. 2 and 3 are cross-sectional views of the stock of FIG. 1, better illustrating the filler material to which, as will be noted from the figures is disposed within the interior cavity 18, and acts to reinforce the stock shell 16 and overall stock. This filler material preferably includes a rigid reinforcing material such as an epoxy resin or other polymeric material 22 with an optional reinforcement filler 24. The filler 24 typically includes either chopped synthetic fibers such as aramid fibers, one grade of which is sold under the trade name Kevlar by Kyntex Inc. of Sequin Texas, glass fibers or carbon fibers and adds strength and rigidity to the filler material 20.

The reinforcing material is typically comprised of a synthetic polymeric material and most preferably is comprised of a hardenable casting resin such as an epoxy resin, urethane resin or the like. As is well-know, to those who are skilled in the art, casting resins are typically provided as a liquid, which is hardenable by heat, ultraviolet light or the addition of chemical curing agents. Once hardened, these resins provide a rigid, durable reinforcing material. One reinforcing material having particular utility in the present invention is epoxy resin and there are a great variety of such resins which may be readily adapted for use in the present invention by one who is skilled in the art. One such resin having particular utility is Acraglas and/or Acraglas Gel, available from Brownells, Inc., Route 2, Box 1, Montezuma, Iowa.

The filler includes a plurality of lightweight, macroscopic displacement members 26 which create voids therein in the reinforcing material. Preferably, the displacement members 25 occupy only certain regions of the cavity, with the remaining portions being filled by a solid body of the reinforcing material. Certain critical areas of the stock such as the bedding area 14, (see FIG. 1) should be solid to ensure the stability and accuracy of the fire arm. And for this reason, it is preferable to restrict the displacement members 21 from such areas. Typically a large volume of the interior of the stock is a matrix of rigid material surrounding a plurality of voids, not unlike a honeycomb. This void-filled matrix occupies the space between the solid bedding area 14 and stock shell 16 and provides a rigid connection therebetween, while reducing the overall weight of the stock and inhibiting transmission of recoil energy.

The term "macroscopic displacement members" as used herein is meant to refer to members in a size range of approximately 1 millimeter and larger, and preferably 5–25 millimeters. The displacement members are less dense than the solid reinforcing material and function to lighten the body of reinforcing material. As such, the macroscopic displacement members are differentiated from micro spheres, mineral particles and other fillers typically employed in conjunction with various polymers.

The lightweight, macroscopic displacement members 26 can be any one of a number of space occupying lightweight substances, preferably in the above-noted size range of 1 to 25 millimeters, and typically in a size range of 5–10 millimeters. A first preferred embodiment of the present invention utilizes hollow gelatin or protein capsules 32, typically used for encapsulating pharmaceuticals, as displacement members. These hollow capsules 32 have rigid exterior shells and, when mixed with the epoxy resin 22, they create voids surrounded by a hard epoxy resin 22 matrix. The hollow capsules 32 at least partially dissipate into the epoxy resin 22 as curing occurs, leaving an empty void associated with the space occupied by the hollow capsule 32. The rigid exterior of hollow capsule 32 ensures that a fully developed void forms, yet it does not remain a distinct entity. Thus, no chance exists for pieces of hollow capsule 32 to rattle about the voids. Such capsules are readily available from a number of sources, one such source being Phomo Phill Corp., 3190 Devon Dr., Windsor, Ontario.

A second embodiment of the invention utilizes expanded polystyrene pellets 36 as displacement members. These pellets 36, while not totally hollow, closely match the lightweight nature of hollow voids. Expanded polystyrene pellets 36 have a large volume to weight ratio and provide a practical, lightweight displacement member 26. The solid expanded polystyrene pellet occupies space when mixed in the epoxy resin 22 and remains in the hard epoxy resin 22 matrix. Further, because they are solid, pellets 36 do not pose a problem of rattling in the created voids. Expanded polystyrene pellets may be obtained from 3M Corporation. Obviously, other types of displacement members will be apparent to one of skill in the art. For example, hollow glass or polymeric members may be employed, as may solid particles of a low density materials such as balsa wood or polymeric compounds.

After filling the non-critical areas of the cavity 18, with the lightweight displacement members 26, epoxy resin 22, and fiber reinforcement filler 24, one or more layers of fiber cloth 28 are positioned within a portion of the epoxy resin 22 to provide a contact surface for accurately engaging the firearm action 10 and barrel 12 in bedding area 14. The bedding area 14 molds around the individual action 10 and barrel 12, providing a complete contact surface and no space remains for action movement.

Several advantages to the present invention exist. The stock retains the look and feel of a conventional wood stock while the internal composite provides constant uniform bedding to the action 10 and barrel 12. The bonding of the internal composite eliminates any tendency of the wood stock shell 16 to warp, while resisting compression and providing a greater degree of accuracy through uniform bedding and support. The stock design does not contribute to stock damage since there is no tolerance allowed for action movement. Apparent recoil is reduced, by virtue of the reduction of action movement and by the honeycomb design which does not freely transmit shock waves as does a hard solid object. Finally, overall weight remains less than a solid wood stock.

The stock of the present invention may be fabricated to include a plurality of discrete cavities therein, each cavity filled with a reinforcing material and having displacement members in at least a portion thereof. In many instances, firearm stocks are fabricated to include a single, interconnected butt stock-fore stock and in such instance it may be desirable for ease of fabrication and/or retention of strength to separately hollow out the butt stock and fore stock portions of the rifle stock and to fill each of the hollowed portions as previously described. In other instances, particular firearm stocks are fabricated in several discrete portions. For example, a rifle stock frequently includes a separate butt stock and fore stock portion. In keeping with the principles of the present invention, each of the stock portions, or for that matter, only one of the stock portions, may be hollowed and treated as aforedescribed. Obviously, the principles hereof may be applied to any design of firearm stock as well as to pistol grips and the like.

While the present invention was described with reference to firearm stocks, the principles thereof, particularly the concept of providing a reinforcing body including a plurality of displacement members therein, are applicable to a variety of technologies. Accordingly, the present invention may be employed anywhere where there is required a lightweight internally reinforced structure. For example, a door for a home or garage could be manufactured using the present invention, to provide a lightweight, reinforced structure. Other obvious applications include walls, frames, furniture and any hollow or tubular structure.

In light of the foregoing, it will be apparent to one of skill in the art that the present invention may be practiced in many embodiments other than those shown herein. The foregoing drawings, description, and discussion are merely illustrative of particular embodiments of the invention and are not limitations on the practice thereof. It is the following claims, including all equivalents thereof, which define the scope of the invention.

Having thus disclosed my invention, I claim:

1. A lightweight, reinforced stock for a firearm, said stock comprising:

a hollow shell defining an exterior surface of the firearm stock, said shell further defining an interior cavity;

a body of rigid, reinforcing material disposed in at least a portion of said interior cavity; and, a plurality of lightweight, macroscopic displacement members disposed in the body of rigid reinforcing material, whereby the rigid reinforcing material strengthens said stock while the displacement members create a plurality of macroscopic voids in said rigid reinforcing material and reduce the overall weight of said stock.

2. The invention of claim 1, wherein at least a portion of said hollow shell is natural wood.

3. The invention of claim 1, wherein at least a portion of said hollow shell includes a synthetic polymer.

4. The invention of claim 1, wherein said hollow shell further defines at least one additional interior cavity.

5. The invention of claim wherein said lightweight reinforced stock further includes:

a second hollow shell defining a second exterior surface of the firearm stock, said shell further defining a second interior cavity;

a second body of rigid reinforcing material disposed in at least a portion of said second interior cavity;

and, a second plurality of lightweight macroscopic displacement members disposed in said second body of rigid reinforcing material.

6. The invention of claim 1, wherein said rigid reinforcing material further includes a fibrous material dispersed therein so as to aid in strengthening said stock.

7. The invention of claim 6, wherein said fibrous material includes chopped glass fibers.

8. The invention of claim 6, wherein said fibrous material includes chopped aramid polymer fibers.

9. The invention of claim 1, wherein said rigid reinforcing material includes an epoxy resin.

10. The invention of claim 1, wherein said plurality of lightweight macroscopic displacement members are configured to create a plurality of macroscopic voids in said rigid reinforcing material, said voids being at least five millimeters in diameter.

11. The invention of claim 1 wherein said plurality of lightweight macroscopic displacement members are comprised of a plurality of rigid, hollow, gelatin capsules of a composition which at least partially disperses into said rigid reinforcing material as said rigid reinforcing material cures.

12. The invention of claim 1, wherein said plurality of lightweight macroscopic displacement members is comprised of a plurality of polystyrene pellets.

13. A lightweight reinforced stock for a firearm having a barrel and receiver, said stock comprising:

a hollow shell defining the exterior surface of a firearm stock, said shell further defining an interior cavity;

a first body of rigid reinforcing material disposed in at least a portion of said cavity proximate said firearm receiver and barrel, said body of rigid reinforcing material comprising an epoxy resin having a fibrous material dispersed therein;

a second body of rigid reinforcing material disposed in at least a portion of said cavity remote from said firearm receiver, and barrel said body of rigid reinforcing material comprising an epoxy resin having a fibrous material dispersed therein; and a plurality of lightweight, macroscopic displacement members disposed in said second body of rigid reinforcing material, whereby said first body of rigid reinforcing material contacts said firearm receiver and barrel, and said first and second bodies of rigid reinforcing material strengthen the stock, and said plurality of lightweight, macroscopic displacement members create a plurality of voids in the second body of rigid reinforcing material and reduce the overall weight of the stock.

14. The invention of claim 13, wherein said hollow shell is fabricated from natural wood.

15. The invention of claim 13, wherein said hollow shell is fabricated from a synthetic polymer.

16. The invention of claim 13, wherein said plurality of lightweight macroscopic displacement members are configured to create a plurality of macroscopic voids in said rigid reinforcing material, said voids further being at least five millimeters in diameter.

17. The invention of claim 13, wherein said plurality of lightweight macroscopic displacement members are comprised of a plurality of rigid, hollow, gelatin capsules which are fabricated from a material which at least partially dissolves into said rigid reinforcing material as said rigid reinforcing material cures.

18. The invention of claim 13, wherein said plurality of lightweight macroscopic displacement members are comprised of a plurality of polystyrene pellets.

* * * * *

UNITED STATES PATENT AND TRADEMARK OFFICE

CERTIFICATE OF CORRECTION

PATENT NO. : 4,934,084

DATED : June 19, 1990

INVENTOR(S) : Mitchell Thomas

It is certified that error appears in the above-identified patent and that said Letters Patent is hereby corrected as shown below:

Column 5, line 62, after "claim: should be inserted --1,--.

Column 6, line 18, after "1" should be inserted --,--.

Signed and Sealed this

Twenty-fifth Day of June, 1991

*Attest:*

*Attesting Officer*

HARRY F. MANBECK, JR.

*Commissioner of Patents and Trademarks*